US006898807B2

(12) United States Patent
Tash

(10) Patent No.: US 6,898,807 B2
(45) Date of Patent: May 31, 2005

(54) SNAKE PLUNGER

(75) Inventor: George Tash, Somis, CA (US)

(73) Assignee: Tash Family Trust, Moor Park, CA (US)

( * ) Notice: Subject to any disclaimer, the term of this patent is extended or adjusted under 35 U.S.C. 154(b) by 94 days.

(21) Appl. No.: 10/216,093

(22) Filed: Aug. 10, 2002

(65) Prior Publication Data

US 2004/0025235 A1 Feb. 12, 2004

(51) Int. Cl.[7] ..... E03D 9/00
(52) U.S. Cl. ..... 4/255.01; 4/255.11; 15/104.33
(58) Field of Search ..... 4/255.08, 255.11, 4/255.12, 255.01; 254/134.3 FT; 15/104.33

(56) References Cited

U.S. PATENT DOCUMENTS

| | | | | | |
|---|---|---|---|---|---|
| D46,996 | S | | 2/1915 | Howell | |
| 1,180,323 | A | | 4/1916 | Schuh | |
| 1,852,071 | A | | 4/1932 | Becker | |
| 2,126,689 | A | | 8/1938 | Pouliot | 4/255 |
| 2,195,830 | A | | 4/1940 | Schubring | 4/255 |
| 2,473,452 | A | | 6/1949 | Scott | 15/104.3 |
| D155,489 | S | | 10/1949 | Mesquita | D9/2 |
| D159,726 | S | | 8/1950 | Grosvold | D9/2 |
| 2,652,571 | A | * | 9/1953 | Hix | 4/255.01 |
| 2,844,826 | A | | 7/1958 | Cheiten | 4/257 |
| 3,031,683 | A | * | 5/1962 | Hellwig | 4/666 |
| D202,979 | S | | 11/1965 | Krusche | D9/2 |
| 3,336,604 | A | | 8/1967 | Lacey et al. | 4/255 |
| 3,644,943 | A | | 2/1972 | Leonardo et al. | 4/255 |
| 3,937,404 | A | | 2/1976 | Johnson | 239/567 |
| 3,994,032 | A | | 11/1976 | Spickofsky | 4/255 |
| 4,174,548 | A | * | 11/1979 | Dunn | 15/104.33 |
| 4,445,236 | A | * | 5/1984 | Nadolny et al. | 4/255.01 |
| 4,539,985 | A | | 9/1985 | Magrath | 128/205.1 |
| D291,933 | S | * | 9/1987 | Weiss | D32/14 |
| D292,631 | S | | 11/1987 | Tash | D32/14 |
| 4,745,641 | A | | 5/1988 | Tash | 4/255 |
| 5,283,922 | A | * | 2/1994 | Ruprecht | 15/104.33 |
| 5,423,621 | A | * | 6/1995 | Russell | 401/9 |
| D364,251 | S | | 11/1995 | Novak | D32/35 |
| D381,146 | S | | 7/1997 | Tash | 8/99 |
| D381,147 | S | | 7/1997 | Tash | 8/99 |
| D385,073 | S | | 10/1997 | Tash | 8/99 |
| 5,862,534 | A | * | 1/1999 | Clay | 4/255.01 |
| 6,145,135 | A | * | 11/2000 | Pool et al. | 4/255.09 |
| 6,192,525 | B1 | * | 2/2001 | Tash | 4/255.11 |
| 6,247,190 | B1 | * | 6/2001 | Rigopoulus | 4/255.12 |

* cited by examiner

*Primary Examiner*—Henry Bennett
*Assistant Examiner*—Amanda Wieker
(74) *Attorney, Agent, or Firm*—Mark A. Watson; Lyon & Harr, LLP

(57) ABSTRACT

This invention relates to a drain plunger that snakes clogged drains at the same time that the drains are being plunged. The "snake plunger" includes a pleated bellows forming a head section which is removably coupled to a handle. Further, in one embodiment, the head and handle sections are jointly configured to release air from within the bellows while the plunger is being inserted into a basin filled with wastewater, thereby reducing or eliminating potential spill-over. Further, a flexible elongated snake disposed within the interior of the bellows enters the drain as the plunger bellows is compressed. The snake is capable of dislodging and breaking up obstructions within a drain. Further, the snake may also have a hook at its lower end that is capable of snaring items causing obstructions within the drain. These features combine to create a plunger that provides a superior ability to effectively clear clogged drains.

32 Claims, 6 Drawing Sheets

SNAKE PLUNGER

BACKGROUND OF THE INVENTION

1. Technical Field

This invention relates to a water and sewage drain plunger for use in clearing clogged drains and drain openings, and in particular, to a drain plunger which is adapted to snake drains and drain openings concurrently with the plunging operation.

2. Background Art

There are various problems associated with plunging a clogged drain. Some of these problems are related to the drain configuration, while other problems are related to the design of the plunger itself.

By way of background, drains such as those in toilets, sinks, and tubs are typically unclogged by using a toilet plunger comprised of a large deformable cup mounted on the end of an elongated handle or shaft. Other plunger designs include a larger air chamber or bellows coupled to a seal. In either case, during the plunging operation, the plunger cup or seal is held over, or inserted into, the mouth of the drain while the plunger handle is reciprocated in an upward and downward motion that alternately contracts and enlarges the space within the cup or air chamber. This reciprocating motion then creates an alternating pressure and suction force in the drain passage that is often sufficient to dislodge an obstruction.

A common problem associated with use of existing plungers is that obstructions within a drain may be too compact, or wedged too tightly within the drain, for alternating pressure and suction forces to dislodge such an obstruction. Further, the bottom end of the plunger cap of typical plunger devices has the tendency to slide about over the surface surrounding the drain opening being cleared. As a result, splashing and/or spillage of standing wastewater from within the basin above the drain are common. Further, the suction force applied by the plunger is often reduced or eliminated by such slippage.

Another problem associated with conventional plunger devices is the limited volume of the plunger cup. This small volume limits the amount of pressure and suction that may be applied to a drain obstruction. Consequently, conventional plungers are often unable to provide sufficient pressure or suction to dislodge an obstruction that is blocking the drain. Another problem typically seen with these cup-type plungers is the tendency for wastewater to spray out with great force from between the plunger cup and the surface surrounding the drain opening. The wastewater then often splashes up and outside of the basin surrounding the drain and onto the operator and nearby walls and floors. This phenomenon is called "splash back."

In addition, existing plungers tend to displace a relatively large quantity of wastewater when the plunger is inserted into the basin above a clogged drain. This displaced wastewater typically spills over the top of a full basin and onto surrounding surfaces and floors. This phenomenon is known as "spillover."

Therefore, in order to overcome the limitations of prior plunger devices, what is needed is a plunger that will reliably dislodge obstructions lodged within a drain while seating securely in or around a drain opening to avoid the problems of splashing and spillage of wastewater, and of reduction in suction force. Further, the plunger should have a large volume that smoothly and slowly compresses to a relatively small volume during use. This feature serves the dual purpose of providing the maximum possible pressure and suction force to an obstructed drain while avoiding splash back. In addition, the plunger should displace a minimum amount of wastewater during use to avoid the problem of spillover. Finally, such a plunger should be simple, capable of being easily fabricated and used, and should be inexpensive and durable.

SUMMARY

A "snake plunger" according to present invention satisfies all of the foregoing needs. The snake plunger is adapted for use with a variety of sizes and shapes of drain openings such as are common in toilets, sinks, tubs, etc. The design of the plunger embodied in the present invention is such that the problems of drain blockage, slippage, splashing, spillage, splash back, and spillover are lessened or eliminated. Furthermore, the plunger can be easily and inexpensively molded, preferably of durable rubber or plastic. The plunger is also lightweight and easy to use.

In general, a plunger according to present invention consists of an elongated handle attached to the upper end of an elongated "head" section, a seal section which is attached to the lower end of the head section, and a flexible internal "snake" which extends through the interior of the head, and is attached to the interior of the top of the head section. In alternate embodiments, the handle is either permanently or releasable attached to the head section. In one embodiment, the head section of the plunger is a pleated bellows which is generally conical and of decreasing diameter from top to bottom. Further, because the head section decreases in diameter towards the bottom of the head, displacement of wastewater from within the basin is minimized.

In operation, the snake plunger is placed into position above a clogged drain. Next, as pressure is applied downward on the handle, the bellows forming the head section compresses, and the portion of the seal in contact with the drain opening forms a mechanical and/or a pressure/suction seal with the drain opening, depending upon the size of the drain opening. Consequently, the pressure generated by compression of the bellows is directed through the sealing structures and into the drain in the direction of the obstruction. Further, at the same time, the snake extends through the seal section and into the drain during compression of the bellows. Next, as the handle is then pulled upwards, a suction force is applied to the obstruction in the drain. These reciprocating forces, in conjunction with the movement of the snake into and out of the drain effectively and rapidly dislodges obstructions from within the drain, thereby facilitating rapid clearing of the drain.

In an alternate embodiment, the handle and head section are jointly configured to release air from within the head section by loosening the handle slightly when inserting the head of the plunger into a basin filled with wastewater. This release of air from the head serves to simultaneously allow wastewater into the head so as to avoid the problem of spillover. Tightening the handle then serves to prevent the flow of air from within the head. In a related embodiment, a one-way bleed valve or the like is included in either the head or handle for releasing air from within the bellows for minimizing displacement of wastewater when inserting the head of the plunger into a basin filled with wastewater.

The bottom end of the plunger consists of a seal section that depends from the bottom of the bellows. A seal located at the bottom of the seal section is designed to either seat securely within a typical drain opening, or alternately, in the case where the drain opening is smaller in diameter than the seal, to form a pressure seal around the smaller drain opening. This seal is capable of forming either or both a mechanical and pressure seal with the drain hole being cleared by the plunger, depending upon the diameter of the drain opening. The seal improves the pressure and suction forces applied by the plunger while serving to limit or prevent the lateral slippage that is responsible for splashing and/or splash back of wastewater from within the basin. Further, a flat bottom end of the seal section allows the plunger to form a pressure seal with the surface surrounding a smaller drain opening. In addition, alternate seal designs and shapes are used in various embodiments to adapt the snake plunger to better interface with various sizes, shapes, and styles of drain openings.

As noted above, the flexible "snake" extends through the interior of the head, and is coupled to the interior of the top of the head section within the bellows. In one embodiment, the snake is removably attached to the interior of the top of the head section, while in another embodiment, it is permanently attached to the interior of the top of the head section. In general, the snake is a elongated member that extends through the seal section and into the drain during compression of the bellows while plunging a drain as described in detail herein. This snake is adapted to directly impinge upon obstructions within the drain to facilitate the breakup and dislodging of such obstructions. Further, because the snake extends into a drain concurrently with the pressure generated during bellows compression, obstructions may be rapidly cleared. As the bellows is expanded, the snake retracts back into the bellows.

In related embodiments, compression of the bellows is used to direct compressed air from within the bellows and into the snake. In these related embodiments, the compressed air entering the snake is then used to extend the snake further into the drain, or alternatively, to assist in clearing blockages within the drain by venting compressed air through the end of the snake and thus into the drain in the direction of the obstruction.

Finally, in still another embodiment, the end of the snake which enters the drain during compression of the head is generally hook-shaped. This hook-shaped end is capable of snaring obstructions within the drain, such as, for example, a diaper or washcloth stuck within a toilet drain.

In addition to the just described benefits, other advantages of the snake plunger will become apparent from the detailed description which follows hereinafter when taken in conjunction with the accompanying drawing figures.

DETAILED DESCRIPTION OF THE PREFERRED EMBODIMENTS

In the following description of the preferred embodiments according to the present invention, reference is made to the accompanying drawings, which form a part hereof, and which are shown by way of illustration of specific embodiments in which the invention may be practiced. It is understood that other embodiments may be utilized and structural changes may be made without departing from the present scope of the invention.

1.0 Overview:

In general, a "snake plunger," as described herein, operates to simultaneously plunge and snake clogged drains. In particular, the snake plunger operates by first placing the snake plunger into position above a clogged drain. Next, as pressure is applied downward on a handle of the snake plunger, a compressible pleated head section of the snake plunger compresses, and a portion of a seal in contact with a drain opening forms a mechanical and/or a pressure/suction seal with that drain opening, depending upon the size of the drain opening. Consequently, the pressure generated by compression of the head is directed through the seal and into the drain in the direction of the obstruction. Further, at the same time, a snake disposed within the interior of the head section of the snake plunger extends through the seal section and into the drain during compression of the head. Next, as the handle is then pulled upwards, a suction force is applied to the obstruction in the drain, while at least partially retracting the snake from the drain. These reciprocating forces, in conjunction with the movement of the snake into and out of the drain, serve to effectively and rapidly dislodge obstructions from within the drain, thereby facilitating rapid clearing of the drain.

Figure 1A:
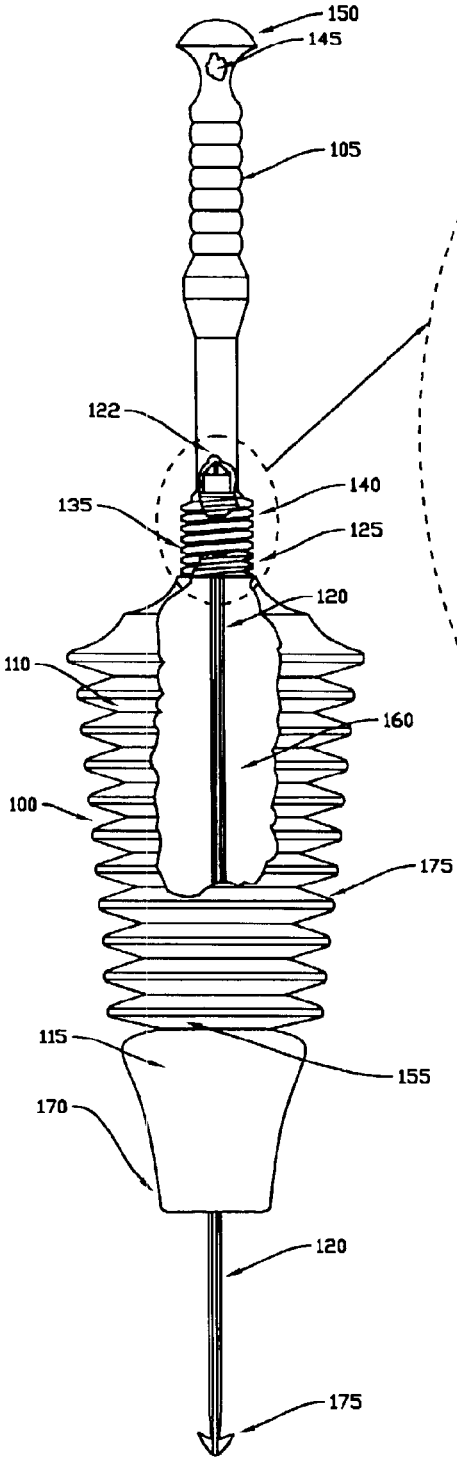
FIG. 1A is a schematic side elevation, partially broken away, of a drain plunger according to the present invention shown in a standing resting condition.
Figure 2A:
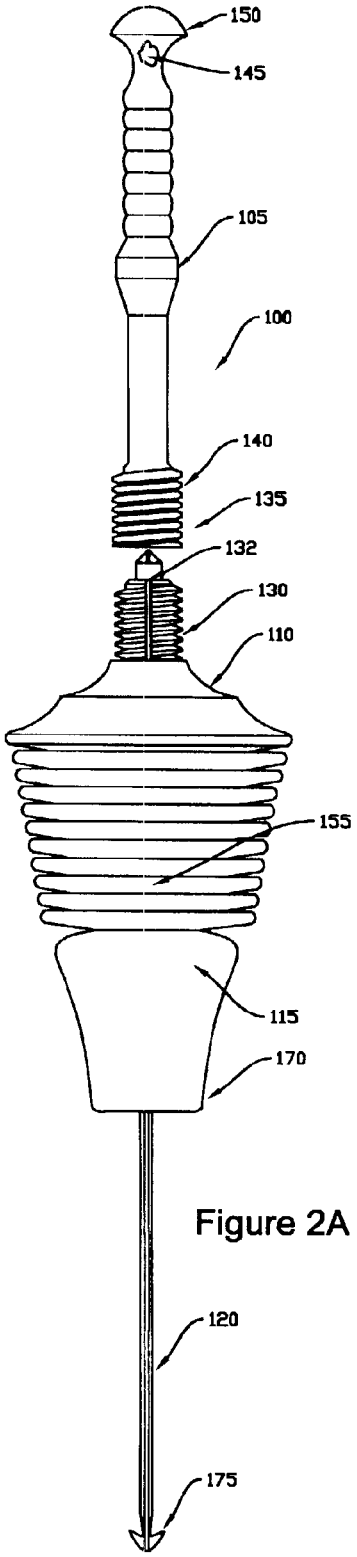
FIG. 2A is a schematic side elevation, partially broken away, of the plunger of FIG. 1 shown with the plunger bellows fully compressed as occurs when the plunger is in use.

2.0 Components:

As shown in FIGS. 1A and 2A, a "snake plunger" 100 according to present invention includes an elongated handle 105, an open ended head section 110 coupled to the base of the handle, a seal section 115 extending from the end of the head section, and an internal snake 120 disposed within the head. The head 110, seal section 115, and snake 120 are preferably made from durable flexible rubber or plastic material which is preferably a blow molded material. However, in alternate embodiments, the snake 120 is made from other flexible or semi-rigid materials, such as, for example, flexible spring steel. The handle 105 can be made from the same material as the head 110, seal 115, and snake 120, or may be made from other materials such as, for example, wood, ceramic, or metal.

Figure 3:
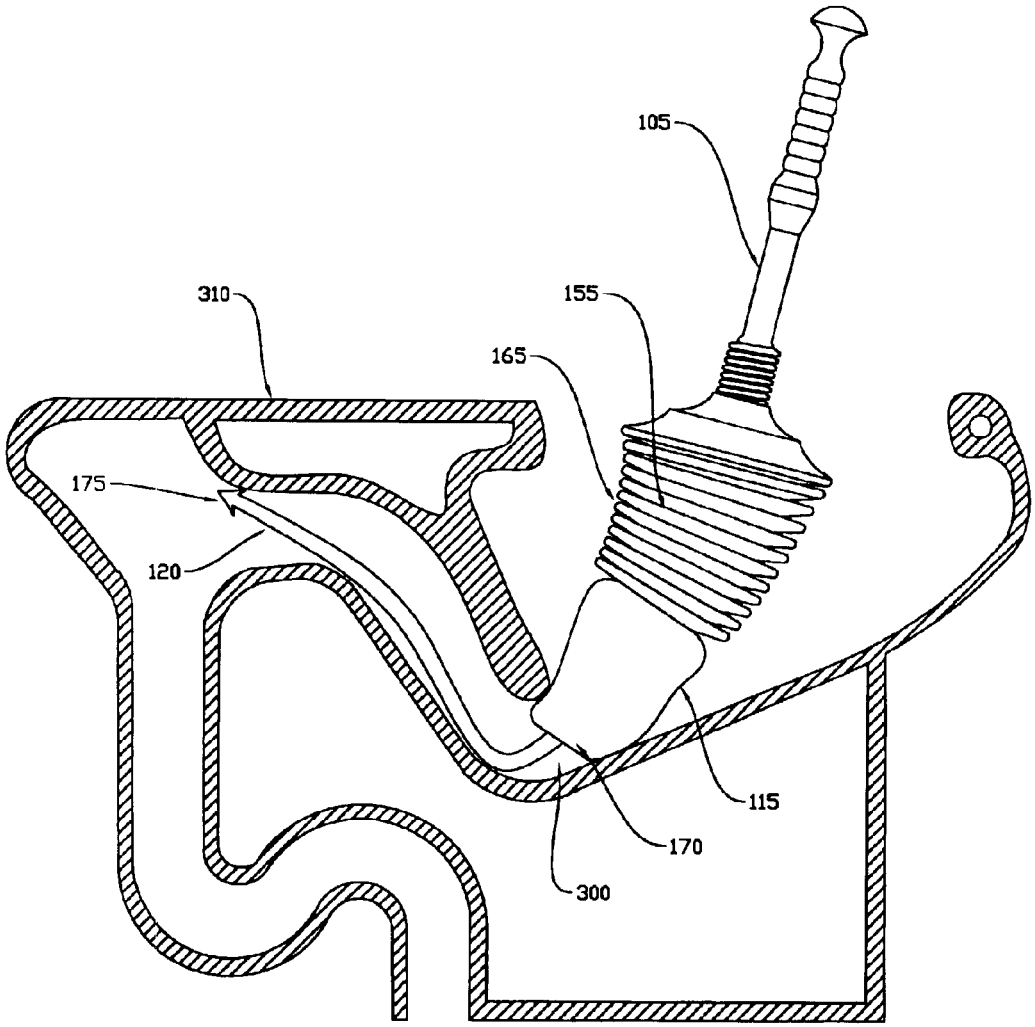
FIG. 3 is schematic side elevation of the plunger of FIG. 1A shown in sealing contact with the drain opening in a typical toilet.

2.1 The Head:

The head section 110 of the plunger 100 is an elongated pleated bellows 155 which is generally conical and of decreasing diameter from top to bottom. The bottom of the bellows 155 is relatively narrow in comparison to the top of the bellows. The bellows 155 has thin walls which define a central space 160 forming the internal volume of the bellows. This volume is substantially larger than that of typical cup-type plungers. Further, because pleats 165 forming the bellows 155 are of preferably progressively greater flexibility from the top to the bottom of the bellows, the pleats easily and smoothly compress and nest together into a relatively small volume during use of the plunger as illustrated in FIG. 2A. The ability of the plunger to smoothly compress and nest avoids the sudden rush of pressurized air common to the sudden collapse of the cup of a standard plunger which often causes the splash back problem described previously. The flexibility of the pleats 165 also allows the plunger 100 to be adapted to drains in tight or curved spaces, as the bellows will easily bend to fit such spaces as shown in FIG. 3.

Figure 1B:
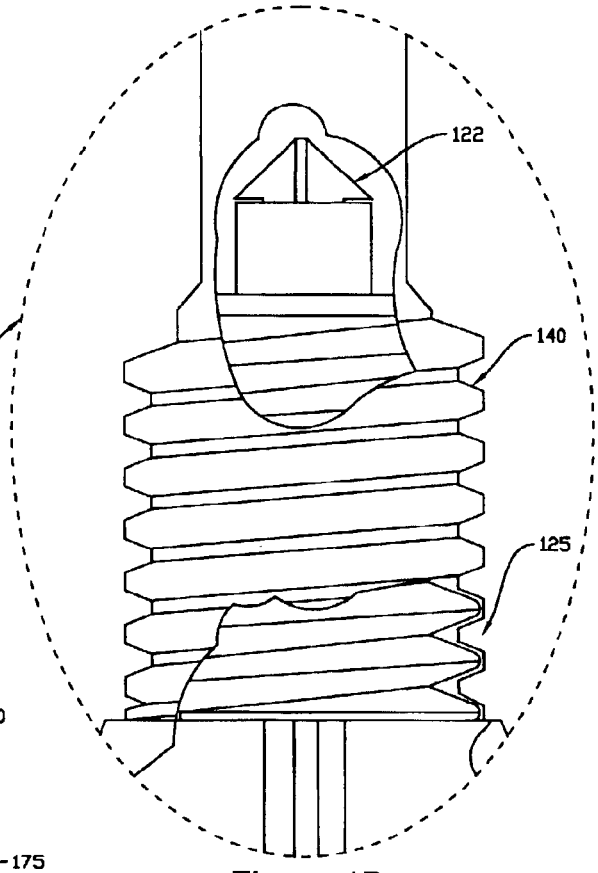
FIG. 1B is a schematic side elevation, partially broken away, of a portion of the drain plunger of FIG. 1A.

2.2 The Handle:

As illustrated by FIGS. 1A and 2A, in one embodiment, the handle 105 is releasably connected to the head 110. Any of a number of types of releasable connections may be used. For example, as illustrated by FIGS. 1A and 1B, in one embodiment, the handle 105 is threadably connected 125 to the head 110. In further embodiments, the handle is releasably connected to the head via a snap-fit mechanism or cotter pin. In still further embodiments, the handle 105 is permanently attached to the head 110 by conventional methods such as, for example, an integrally molded handle, or a handle permanently glued, riveted, or otherwise attached to the head.

Figure 2B:
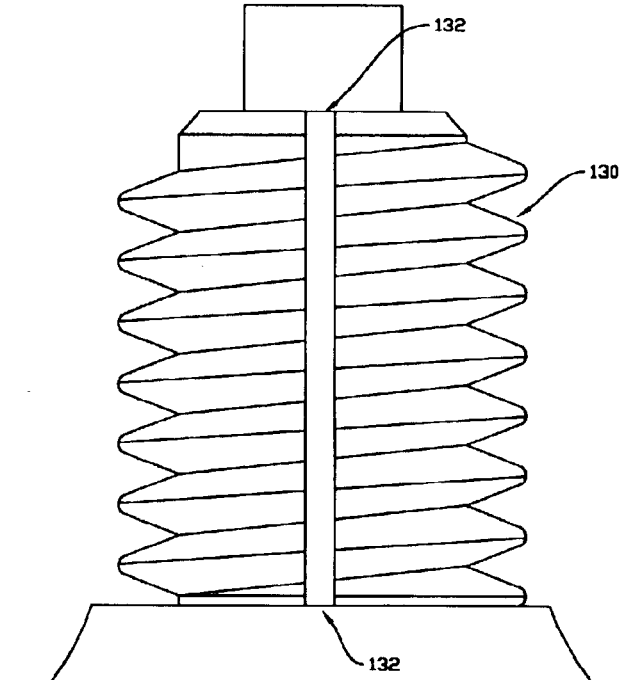
FIG. 2B is a schematic side elevation, partially broken away, of the threaded stud and air channel of the head section of the plunger of FIG. 2A.

In the aforementioned threaded embodiment, the head 110 has a threaded stud 130 extending from its top end, as illustrated by FIGS. 2A and 2B. The handle 105 is preferably hollow at end 135 with threads 140 formed on its inner surface to receive the head's threaded stud 130. In one embodiment, the remainder of handle 105 is also hollow, whether permanently or releasably attached, having a central space 145 therein to reduce its weight. The upper end of the handle 105 is formed into an expanded knob 150 adapted to comfortably rest in the operators' palm when using the plunger. Further, in another embodiment, the upper end of the handle 105 is ribbed to allow the operator to maintain a non-slip grip on the handle during operation.

Further, as illustrated by FIGS. 2A and 2B, in one embodiment, the handle 105 and head 110 are jointly configured to release air from within the head section during compression of the head. In particular, in this embodiment, the threaded stud 130 extending from the top of the head 110 is open on both ends, thereby forming an open pathway or channel extending from the seal 115 through the head, then through the threaded stud and into the hollow end 135 of the handle 105. Further, in this embodiment, a channel 132 is formed along the axis of the threaded stud 130, so that air will flow through the channel, and out of, or into, the head 110 of the snake plunger 100 during compression or expansion of the head. Note however, that as described below, this flow of air may be prevented as desired.

Figure 4:
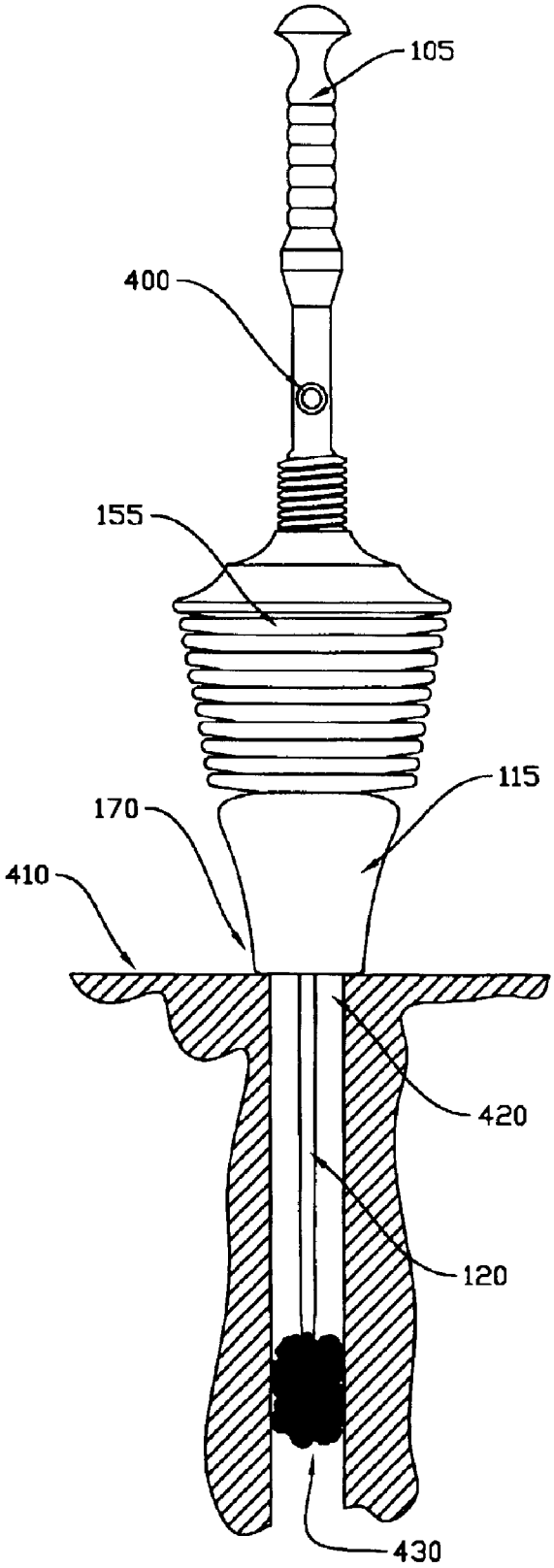
FIG. 4 is a schematic side elevation of an alternate embodiment of a drain plunger according to the present invention shown with the internal snake in direct contact with an obstruction in a drain.

In particular, given this embodiment, air is released from within the head section 110 through the base of the handle 105 by loosening the handle slightly when inserting the head of the plunger into a basin filled with wastewater. This release of air from the head 110 serves to simultaneously allow wastewater into the head so as to avoid the problem of spillover. Tightening the handle 105 then serves to form an air-tight seal between the handle and the treaded knob 130, thereby preventing the flow of air from within the head 110 and out of the base of the handle. In a related embodiment, as illustrated by FIG. 4, a one-way bleed valve or the like 400 is included in either the head or handle for releasing air from within the bellows for minimizing displacement of wastewater when inserting the head of the plunger into a basin filled with wastewater.

In particular, as with the embodiment where a controlled air release is achieved from the handle/head interface, in the embodiment including a bleed valve 400, water enters the plunger through the seal section 115 and displaces a portion of the air within the bellows. This displaced air escapes through the bleed valve as the plunger is inserted into the wastewater. Removing air from the plunger as it is inserted into the wastewater minimizes any potential displacement of that wastewater. Therefore, the maximum amount of water that may be displaced is limited to a volume defined by the wall thickness of the pleats 165 forming the bellows 155, and to the volume displaced by the snake 120. Thus, only a small amount of wastewater may be displaced by the thin-walled pleats 165 and the portion of the snake 120 which enter the wastewater. Once the plunger is in place above a clogged drain, the bleed valve is closed to prevent loss of pressure or suction. The remainder of the operation of this alternate embodiment, including operation of the snake 120, is substantially similar to that described above for the previous embodiments.

2.3 The Seal Section:

The seal section 115 depends from the bottom of the bellows 155 as illustrated in FIGS. 1A and 2A. The seal section 115 has flexible walls having a generally annular shape with a narrow bottom end or "mouth" 170 adapted to be inserted into a typical drain opening, such as, for example, the drain opening of a toilet, sink, or other opening. The mouth 170 opens into the interior of the bellows 155 to alternately direct a pressurized air/fluid flow into, then out of, the drain as the plunger 100 is first compressed then expanded.

The seal section 115 is relatively less flexible than the pleats 165, but is sufficiently flexible to deform inwardly when the plunger is inserted into a typical toilet drain opening 300 as shown in FIG. 3 to form an interference fit type mechanical seal with the walls defining the drain opening. Further, the bottom end of the seal section 115 is flat. This provides the capability for the seal 115 to form a pressure seal with the surface 410 surrounding a drain opening 420 which is smaller in diameter than the mouth 170 of the seal as shown in FIG. 4. For the purpose of this disclosure, the term "pressure seal" will mean a pressure and suction or vacuum seal. The pressure seal is in effect when the plunger is being compressed, and the suction or vacuum seal is in effect when the plunger is being expanded. Note that the seal section 115 can be formed of the same materials as the bellows 155, but of relatively different proportions of those materials than for the bellows so as to control its flexibility. Alternately, the seal section 115 can be formed of the same materials using the same composition as the bellows 155, but of a relatively different thickness than the bellows 155 so as to control its flexibility relative to the bellows.

2.4 The Snake:

FIGS. 1A and 2A illustrate the snake 120 coupled to the interior of the top of the head section 110 within the bellows 155. The snake 120 is preferably an elongated flexible member that extends through the seal section 115 and into a drain during compression of the bellows 155 as shown in FIGS. 3 and 4. The flexibility of the snake 120 gives the snake the capability to deform to conform to curved drain pipes such as are common in sinks and toilets. As the bellows 155 is expanded following compression, the snake 120 retracts at least partially back into the bellows. The snake 120 is adapted to directly impinge upon obstructions within the drain to facilitate the breakup and dislodging of such obstructions. FIG. 4 shows the snake 120 in direct contact with an obstruction 430 in the drain.

Figure 1C:
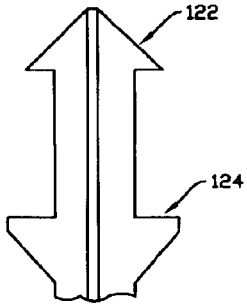
FIG. 1C is a schematic side elevation of a portion of the internal snake of FIG. 1A.

In one embodiment, as illustrated by FIGS. 1A through 1D, the snake 120 is removably coupled to the head section 110 using a type of snap-fit arrangement. In particular, as described above, in one embodiment the threaded stud 130 is open on both ends. Consequently, when attaching the snake 120 to the plunger 100, one end 122 of the snake (as illustrated by FIG. 1C) is simply inserted into the head section 110, with the end 122 being forced through the hollow threaded stud 130. Further, because the end 122 of the snake 120 has a relatively larger diameter than the opening within the hollow threaded stud 130, the end 122 of the snake 120 locks into place within the hollow treaded stud as illustrated by FIGS. 1A and 1B. In addition, to prevent the snake from proceeding too far in to the plunger during use, the snake 120 includes a ridge 124 around the circumference of the snake which is sufficiently larger in diameter than the opening in the hollow stud such that the snake can not be forced further into the plunger than is desired.

Figure 1D:
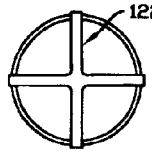
FIG. 1D is a top view of the interface between the internal snake and the head section of the drain plunger of FIG. 1A.
Figure 2C:
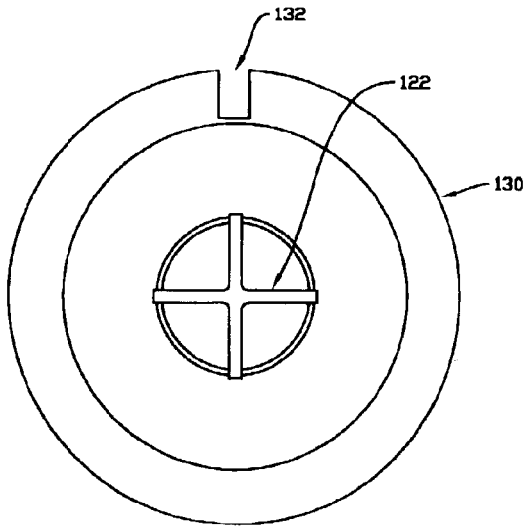
FIG. 2C is a top view of the interface between the internal snake and the head section of the drain plunger of FIG. 2A.

FIG. 1D illustrates a top view of the end 122 of the snake 120 extending from the opening in the hollow threaded stud 130. Not that in this top view, it can be seen that the end 122 of the snake 120 overlaps the edge of the opening within the threaded stud 130, thereby preventing the snake from being inadvertently removed during use of the snake plunger. Similarly, FIG. 2C, also illustrates a top view of the end 122 of the snake 120 extending from the opening in the hollow threaded stud 130. Note that the top view of FIG. 2C, also illustrates the embodiment wherein air is released from the interior of the bellows 155 and out of the handle 1, by forming an air channel 132 along the length of the threaded stud 130. As noted above, air is released by simply loosening the handle slightly prior to use. Conversely, simply tightening the handle serves to complete an air-tight seal which prevents air flow through the channel 132.

Figure 5:
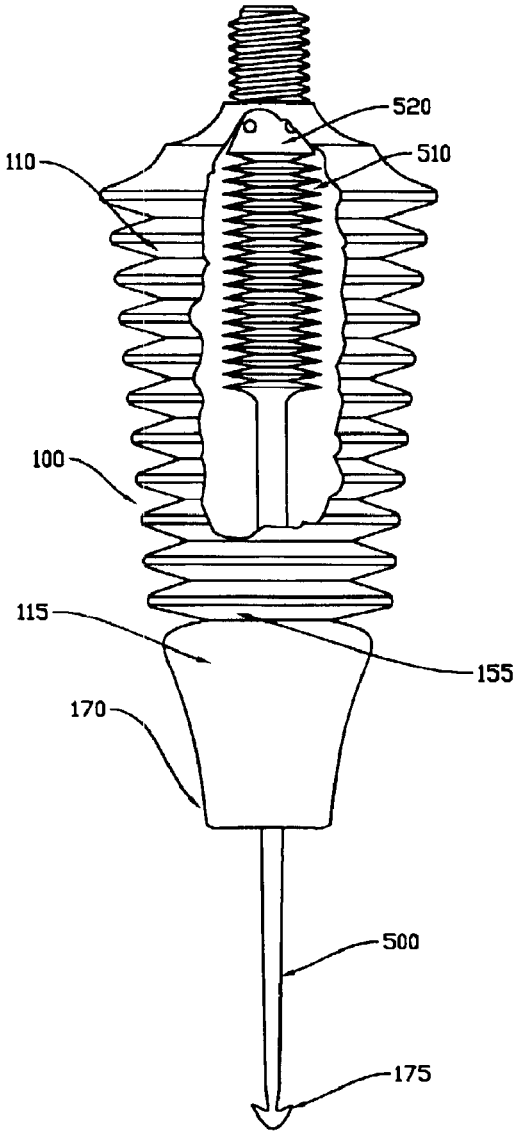
FIG. 5 is a schematic side elevation, partially broken away, of an alternate embodiment of a drain plunger according to the present invention shown in a standing resting condition.
Figure 6:
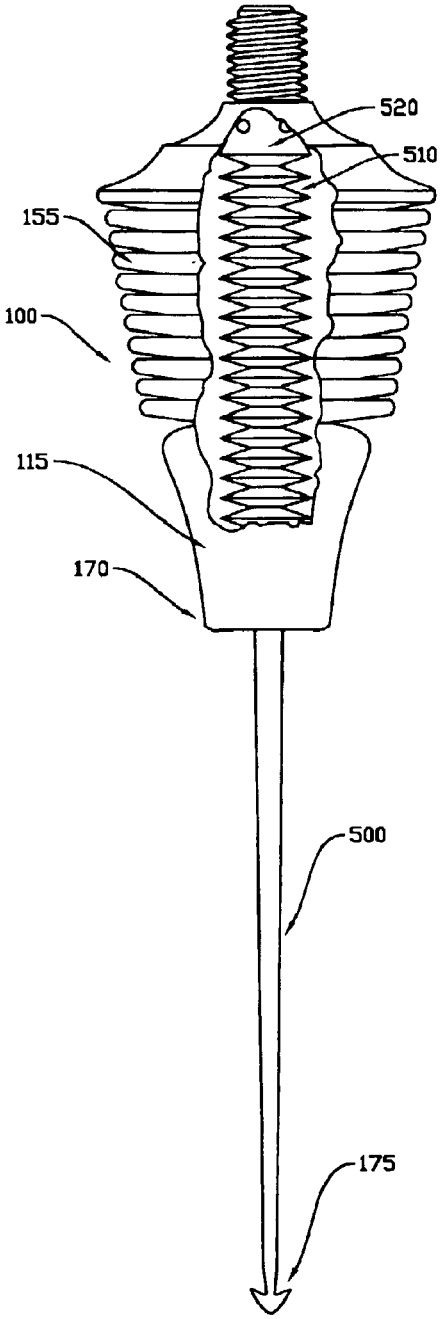
FIG. 6 is a schematic side elevation of the plunger of FIG. 5, partially broken away, shown with the plunger bellows fully compressed as occurs when the plunger is in use.

A further embodiment of the snake is illustrated in FIGS. 5 and 6. In this embodiment, air is not released through the handle during compression, or insertion of the plunger 100 into a basin filled with wastewater. Specifically, a snake 500 is coupled to the base of a snake bellows 510 which is coupled to an air valve 520. The air valve 520 is coupled to the interior of the top of the head section 110 within the bellows 155. The air valve 520 is simply an open fluid pathway between the plunger bellows 155 and the snake bellows 510. As the bellows 155 is compressed, the air within the bellows is directed into the snake bellows 510 via the air valve 520. Consequently, the snake bellows 510 expands as the plunger is compressed (FIG. 6), driving the snake 500 deeper into a drain than is possible with the snake 120 of the previous embodiment. As with the previous embodiment, the snake 500 retracts at least partially back into the bellows 155 as the bellows is expanded following compression.

Figure 7:
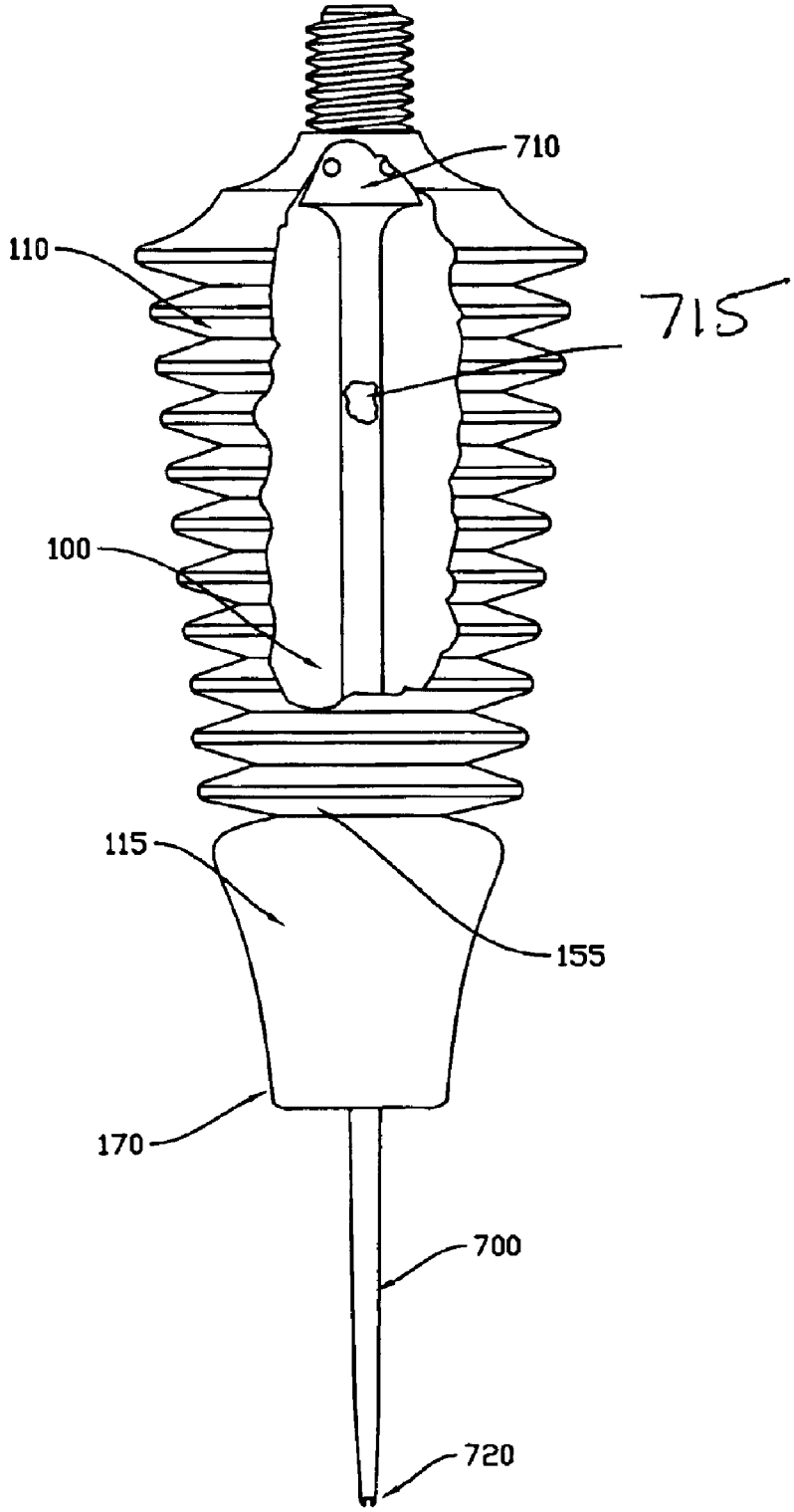
FIG. 7 is a schematic side elevation, partially broken away, of an alternate embodiment of a drain plunger according to the present invention shown with a drain plunger according to the present invention in a standing resting condition.

A further embodiment of the snake 700 is illustrated in FIG. 7. This snake 700 is coupled to an air valve 710 which is in turn coupled to the interior of the top of the head section 110 within the bellows 155. The air valve 710 is substantially similar to the air valve 520 of the previous embodiment. The snake 700 is hollow, having a central space 715, with a through hole 720 at its bottom end. This through hole 720 is in fluid communication with the bellows 155 via the air valve 710. Consequently, as the bellows 155 is compressed, pressurized air from within the bellows enters the snake 700 through the air valve 710 and is injected via the through hole 720 into the drain in the direction of the obstruction. As the end of the snake 700 having the through hole 720 comes into contact with an obstruction, the pressurized air venting from the through hole facilitates the breakup and dislodging of the obstruction.

Finally, as illustrated in FIGS. 1A, 2A, 3, 5, and 6, each of the snake embodiments may also have one or more hooks 175 coupled to the end of the snake, with those hooks providing the capability to snare obstructions within a drain, such as for example a diaper or washcloth stuck within a toilet drain. Further, as shown in FIG. 7, each of the snake embodiments may alternatively have a blunt end 730. Further, any combination of the snake features described above for the various snake embodiments is also possible, such as, for example, a snake having one or more hooks and a through hole for venting pressurized air as described above.

3.0 Operation

As shown in FIG. 3, as the seal mouth 170 is inserted into the drain opening 300, the flexible seal section 115 deforms to form a tight pressure seal with the edges of the drain opening and the surface surrounding the drain opening. The deformation of the seal section 115 thus creates an interference fit/mechanical seal and a pressure seal between the seal section and the drain opening 300. In addition, because the seal section 115 is a generally annular shape which tapers from a larger top end towards the mouth 170, the seal section is capable of forming a mechanical and/or a pressure seal with drain openings of various sizes.

Whether a pressure seal is formed in conjunction with the mechanical seal is dependent upon the size of the drain opening 300. Smaller drain diameters tend to limit the travel of the seal into the drain. Consequently, the upper portion of the seal may not contact the surface surrounding the drain in order to form a pressure seal in conjunction with the mechanical seal that is formed by the mouth of the seal as described above. However, the mechanical seal that is formed is sufficient to allow satisfactory operation of the plunger. Further, because the mouth 170 of the seal section 115 fits snugly into the drain opening 300, it also serves to limit or prevent the lateral slippage that can cause splashing and spillage of wastewater. In cases where the drain opening is smaller than the diameter of the mouth 170, as illustrated in FIG. 4, the flat bottom end of the seal 115 is capable of forming a pressure seal with a surface 410 surrounding the drain opening 420.

The aforementioned mechanical and pressure seals between the seal section 115 and the drain opening are formed as pressure is applied downward on the handle 105, partially compressing the bellows 155 and forcing the seal section into and around the drain opening. This interplay between the seal section and the drain opening in a typical toilet 310 is illustrated in FIG. 3. Similarly, as illustrated in FIG. 4, the aforementioned pressure seal between the seal 115 and the surface 410 surrounding the drain opening 420 is also formed as pressure is applied downward on the handle 105, partially compressing the bellows 155. Further compression of the bellows 155, once the plunger is in place, serves the dual purpose of forcing pressurized air and wastewater into the drain, while at the same time driving the snake 120 into the drain in the direction of the obstruction.

As the handle 105 is then pulled upwards following compression of the bellows 155, the bellows expands and creates a suction force in the drain, creating a pressure seal between the seal section 115 and the drain opening, pulling the obstruction upwards, and preventing the plunger from lifting away from the drain. Because of the tight fit between the seal section 115 and the drain opening, there is no loss of pressure or suction from this interface and the lateral slippage that can cause splashing and spillage of wastewater is prevented. Alternating between pushing and pulling the handle 105 creates a strong reciprocating pressure/suction force in the drain that acts in conjunction with the snake moving into, then out of, the drain. The combination of simultaneously alternating pressure and suction forces with snaking of the drain is generally sufficient to quickly clear any obstruction. In addition, the expanded volume of the bellows 155 of the present plunger in relation to typical plungers creates even greater pressure and suction forces.

4.0 Additional Embodiments

In addition to the embodiments described above, the seal section of each of the aforementioned plunger embodiments may be adapted to better suit particular types and sizes of drains such as those found in sinks or tubs while leaving the remaining features, and thus the operation of the plunger, substantially unchanged. For example, one alternate embodiment of the seal section may include a dual function seal designed both to fit snugly into a typical sink drain opening to form a tight mechanical seal, while also having a flat bottom end which has the capability to form a pressure seal with the surface surrounding a smaller drain. Another alternate embodiment of the seal section may include a seal designed to fit snugly into standard garbage disposal openings. A further alternate embodiment of the plunger uses the bottommost pleat of the bellows to form a pressure seal with the surface surrounding a drain opening.

Further embodiments of the plunger include embodiments wherein the shape of the bellows is varied. Where the plunger head is sufficiently long and narrow to minimize displacement of wastewater when inserted into the wastewater in a basin above a clogged drain, the actual shape of the bellows is of secondary concern. In such a case, so long as the bellows has sufficient volume to produce a satisfactory pressure and suction force when compressed and expanded, the shape of the bellows may be varied for aesthetic reasons without affecting it's performance, usability or durability. For example, the bellows may comprise such shapes as an oval, a cone, a pyramid, or it may have a rectangular cross-section. The bellows may also have a shape which is any combination of these shapes. Further, the bellows may also comprise fanciful shapes, or any other practical shape which is pleasing.

The snake plunger embodied in the present invention has many advantages. The design of this plunger is such that the problems of slippage, splashing, spillage, spillover, and splash back are lessened or eliminated.

Because the mouth of the plunger seal fits snugly within a drain opening, it helps to improve the pressure and suction forces applied by the plunger while serving to limit or prevent the lateral slippage that is responsible for splashing and/or splash back of wastewater from within the basin. The design of the bellows which allows the pleats to easily and smoothly nest, avoids the sudden rush of pressurized air common to the sudden collapse of a standard plunger which often causes the aforementioned splash back problem. Finally, the design of the internal snake provides the capability to break-up and dislodge clogs and obstructions within drains, as well as hooking material within drains so that the material may be easily removed from clogged drains. These features combine to create a plunger that is adapted to provide an enhanced seal in addition to enhanced reciprocating pressure and suction forces while at the same time providing for effective snaking of the clogged drain. Consequently, the plunger has a superior ability to quickly and effectively dislodge obstructions from within drains.

While the invention has been described in detail by specific reference to preferred embodiments thereof, it is understood that variations and modifications thereof may be made without departing from the true spirit and scope of the invention. For example, this invention can also be employed for use with a wide variety of sizes and shapes of drain openings in addition to those found in toilets, tubs, and sinks.

Wherefore having thus described the present invention, what is claimed is:

1. A plunger for snaking a clogged drain, comprising:

a handle threadably connected to a head;

the head comprising a compressible pleated bellows; and a flexible snake coupled to the interior of the head, and extending from an open end of the pleated bellows, said flexible snake having a fixed length which extends a fixed distance from the point at which it is coupled to the interior of the head.

2. The plunger of claim 1 wherein the snake extends into the clogged drain when the head is compressed.

3. The plunger of claim 1 wherein the snake at least partially retracts from the clogged drain when the head is expanded.

4. The plunger of claim 1 further comprising a seal coupled to the bottom of the head.

5. The plunger of claim 4 wherein the seal is capable of fitting securely into a drain opening to form a mechanical seal with walls defining the drain opening.

6. The plunger of claim 4 wherein a top portion of the seal is capable of deforming around the surface surrounding a drain opening to form a pressure seal with that surface.

7. The plunger of claim 4 wherein the seal has the capability to simultaneously form a mechanical seal and a pressure seal with a drain opening.

8. The plunger of claim 4 wherein the seal has a flat bottom having the capability to form a pressure seal with a surface surrounding a drain opening which is smaller in diameter than the seal.

9. The plunger of claim 2 wherein the snake has the capability to bend to conform to curved drain pipes.

10. The plunger of claim 1 wherein the snake further comprises at least one hook coupled to the base of the snake for snaring obstructions within the drain.

11. The plunger of claim 1 wherein tightening the handle serves to close an air passage for preventing air from escaping or entering the head as the head is alternately compressed and expanded during operation.

12. The plunger of claim 1 further comprising an air valve coupled to the interior of the top of the head within the bellows, and wherein the air valve is in fluid communication with the bellows.

13. The plunger of claim 12 wherein a snake bellows is coupled the air valve, and wherein the snake bellows is in fluid communication with the air valve.

14. The plunger of claim 13 wherein the snake is coupled to the snake bellows.

15. The plunger of claim 14 the snake bellows is automatically expanded as the plunger bellows is compressed, thereby extending the snake into the clogged drain.

16. The plunger of claim 14 wherein the snake bellows at least partially contracts as the plunger bellows is expanded, thereby at least partially retracting the snake.

17. The plunger of claims 12 the snake is coupled to the air valve.

18. The plunger of claim 17 wherein the snake is hollow, having a through hole at its bottom end, and wherein the through hole is in fluid communication with the air valve via the hollow snake.

19. The plunger of claim 18 wherein the snake delivers pressurized air into the clogged drain via the through hole as the plunger bellows is compressed.

20. The plunger of claim 19 wherein the handle is integral with the head.

21. A plunger having:

a head including a compressible pleated bellows;

a handle threadably coupled to the top of the head; and a snake disposed within the compressible pleated bellows for snaking clogged drains when the pleated bellows are compressed, said snake having a fixed length which extends a fixed distance from within the compressible pleated bellows.

22. The plunger of claim 21 wherein tightening the threadably coupled handle serves to close an air passage integrated into a threaded stud extending from the top of the head for threadably receiving the threadably coupled handle, and wherein closing the air passage prevent air from escaping or entering the head as the head is alternately compressed and expanded during operation.

23. The plunger of claim 21 wherein the snake is removably attached to the interior of the head.

24. The plunger of claim 21 wherein the snake is removably attached to an air valve coupled to the interior of the top of the head within the bellows, and wherein the air valve is in fluid communication with the bellows.

25. The plunger of claim 24 wherein the snake is hollow, and wherein the snake has a through hole at its bottom end for injecting pressurized air into a clogged drain, wherein the pressurized air is transmitted to the snake from the bellows via the air valve as the plunger bellows is compressed.

26. The plunger of claim 21 wherein the snake is sufficiently flexible to bend to conform to a curved drain pipe.

27. The plunger of claim 21 the snake further comprises at least one hook coupled to its bottom end, and wherein the hook has the capability to snare at least one obstruction within a clogged drain.

28. The plunger of claim 24 wherein the snake further comprises a snake bellows, and wherein the snake bellows is in fluid communication with the plunger bellows via the air valve.

29. The plunger of claim 28 wherein the snake bellows expands as the plunger bellows is compressed, thereby extending the length of the snake.

30. The plunger of claim 25 wherein the snake further comprises at least one hook coupled to its bottom end, and wherein the hook has the capability to snare an obstruction within a drain pipe.

31. The plunger of claim 1 wherein loosening the handle serves to open an air passage for allowing air to escape from within the head as the head is inserted into a basin filled with wastewater above the clogged drain.

32. The plunger of claim 21 wherein loosening the threadably coupled handle serves to open an air passage integrated into a threaded stud extending from the top of the head for threadably receiving the threadably coupled handle, the air passage allowing air to escape from within the head as the head is inserted into a basin filled with wastewater above the clogged drain.

* * * * *